US005082983A

United States Patent [19]

Breckenridge et al.

[11] Patent Number: 5,082,983

[45] Date of Patent: Jan. 21, 1992

[54] REDUCTION OF BENZENE CONTENT OF REFORMATE IN A CATALYTIC CRACKING UNIT

[75] Inventors: Lloyd L. Breckenridge, Philadelphia, Pa.; Diane V. Jorgensen, Wilmington, Del.; Ajit V. Sapre, West Berlin, N.J.

[73] Assignee: Mobil Oil Corporation, Fairfax, Va.

[21] Appl. No.: 583,266

[22] Filed: Sep. 14, 1990

[51] Int. Cl.[5] ..... C07C 5/22; C07C 5/52

[52] U.S. Cl. ..... 585/475; 585/410; 585/467; 585/940; 208/66; 208/111; 208/120; 208/113

[58] Field of Search ..... 585/475, 467, 940, 410; 208/66, 111

[56] References Cited

U.S. PATENT DOCUMENTS

| | | | |
|---|---|---|---|
| 2,739,991 | 3/1956 | Hervert | 260/672 |
| 2,996,447 | 8/1961 | Porter et al. | 208/66 |
| 3,692,858 | 9/1972 | Brewer et al. | 208/89 |
| 3,716,596 | 2/1973 | Bowes | 260/671 |
| 3,719,586 | 3/1973 | Benner | 208/66 |
| 3,763,260 | 10/1973 | Pollitzer | 585/475 |
| 3,855,328 | 12/1974 | Hedge | 260/668 |
| 3,873,439 | 3/1975 | Pollitzer | 208/66 |
| 3,928,174 | 12/1975 | Bonacci et al. | 585/475 |
| 3,948,758 | 4/1976 | Bonacci et al. | 585/475 |
| 3,957,621 | 5/1976 | Bonacci et al. | 585/475 |
| 3,969,426 | 7/1976 | Owen et al. | 260/668 |
| 3,996,305 | 12/1976 | Berger | 585/475 |
| 4,112,056 | 9/1978 | Chen et al. | 208/111 |
| 4,136,128 | 1/1979 | Haag et al. | 260/671 R |
| 4,140,622 | 2/1979 | Herout et al. | 208/93 |
| 4,157,950 | 6/1979 | Frilette et al. | 585/475 |
| 4,172,813 | 10/1979 | Feinstein et al. | 585/475 |
| 4,237,329 | 12/1980 | Kamiyama et al. | 585/475 |
| 4,320,242 | 3/1982 | Onodera et al. | 585/484 |
| 4,393,262 | 7/1983 | Kaeding | 585/467 |
| 4,454,364 | 6/1984 | Farcasiu et al. | 585/470 |
| 4,469,908 | 9/1984 | Burress | 585/467 |
| 4,504,690 | 3/1985 | Forbus et al. | 585/467 |
| 4,554,394 | 11/1985 | Forbus et al. | 585/475 |
| 4,577,049 | 3/1986 | Rudnick | 585/486 |
| 4,827,069 | 5/1989 | Kushnerick et al. | 585/415 |

*Primary Examiner*—Helane E. Myers
*Attorney, Agent, or Firm*—A. J. McKillop; C. J. Speciale; Richard D. Stone

[57] ABSTRACT

A process for reducing the benzene content of a reformate stream in a conventional catalytic cracking reactor wherein a heavy hydrocarbon feed is cracked to lighter products by contact with a supply of hot regenerated cracking catalyst is disclosed. The reformate can be mixed with the heavy feed to the cracking reactor, but preferably reformate contacts hot regenerated cracking catalyst before the heavy feed is added. Benzene content is reduced by alkylation with reactive fragments created in the cracking reactor, or by transalkylation with alkyl aromatics. Benzene removal can be enhanced by adding a light reactive gas such as ethylene to the cracking reactor, by adding heavier aromatics, such as a light cycle oil, or both. The reaction is preferably conducted in an FCC riser reactor, but may be conducted in a moving bed cracking reactor.

20 Claims, 2 Drawing Sheets

REDUCTION OF BENZENE CONTENT OF REFORMATE IN A CATALYTIC CRACKING UNIT

BACKGROUND OF THE INVENTION

1. Field of the Invention

The invention relates to catalytic cracking and reforming.

2. Description of Related Art

The present invention relates to an unusual way of overcoming a problem in one mature processes, catalytic reforming by making unconventional use of another mature process, catalytic cracking. The problem is low octane number and/or excessive benzene content in the C6 reformate.

Catalytic reforming of naphtha boiling range feeds over platinum based catalyst to produce high octane reformate is one of the most successful processes in the world. More than a hundred units are in use, converting low octane naphthas to high octane, aromatic rich gasoline. The only problem with the process is that the product inherently contains large amounts of aromatics, including benzene. Many localities are limiting the amount of benzene which can be contained in gasoline, because of the toxic nature of benzene. Another minor problem in some catalytic reforming units is that the octane number of the gasoline produced varies significantly with boiling range. The light reformate, e.g, the C6− fraction, sometimes has a lower octane than desired and lower than the octane of the C7+ fraction. The C6− fraction can be doubly troubling to refiners, having a shortage of octane and an excess of benzene.

Usually refiners have looked on catalytic reformers as aromatics generators, and welcomed, rather than avoided, the production of aromatic hydrocarbons. Many refineries recover benzene rich streams, usually by L/L extraction with a solvent such as Sulfolane, and then alkylate the purified streams with light olefins. Such processing, to produce ethylbenzene or xylenes, usually requires highly purified benzene. This approach inherently tends to produce a by-product gasoline with a lower benzene content, but can only be justified when there is demand for a high value product such as ethylbenzene, and capital available to build expensive solvent purification facilities. There is a need for a simpler approach, which can make better use of existing refinery facilities, and which requires only fractionation to isolate a benzene rich fraction.

Refiners considering benzene in light reformate a problem, rather than a source of valuable petrochemicals, have solved the problem in various ways. In U.S. Pat. No. 4,140,622, Herout et al, which is incorporated herein by reference, a reformate was fractionated to provide a benzene rich fraction which was then mixed with C3/C4 olefins and passed over an alkylation catalyst such as SPA, or solid phosphoric acid. In U.S. Pat. No. 4,209,383, Herout et al, which is incorporated herein by reference, a reformate and C3-C4 olefins from an FCC were combined, then passed through a dehexanizer, then passed through an alkylation zone.

While concentrating a benzene rich fraction by distillation with light olefins will work, it requires a source of light olefins. Most refineries with catalytic cracking units produce large amounts of light olefins, but invariably also have HF or sulfuric acid alkylation units which convert these olefins into high octane, aromatic free, alkylate. Thus once a refiner puts in a cat cracker, it is usually essential to put in an "alky" unit to consume the olefins generated by the cat cracking process, and conversion of light olefins to alkyl aromatics (by reaction with a benzene rich fraction of reformate) reduces the amount of non-aromatic gasoline that can be produced by alkylation, and increases the production of aromatic gasoline, although the aromatics will be heavier than benzene by virtue of alkylation. This can be better understood by reviewing briefly what goes on during conventional catalytic cracking.

Catalytic cracking of hydrocarbons has enjoyed worldwide success. It is probably the method of choice for converting a heavy feed into lighter, more valuable products, the most valuable of which are usually the high octane gasoline and the light olefins. Catalytic cracking of hydrocarbons is carried out in the absence of externally supplied H2, in contrast to hydrocracking, in which H2 is added during the cracking step. An inventory of particulate catalyst is continuously cycled between a cracking reactor and a catalyst regenerator. In the fluidized catalytic cracking (FCC) process, hydrocarbon feed contacts catalyst in a reactor at 425C-600C, usually 460C-560C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen containing gas, usually air. Coke burns off, restoring catalyst activity and simultaneously heating the catalyst to, e.g., 500C-900C, usually 600C-750C.

Modern FCC regenerators tend to operate at fairly high temperatures, both to minimize CO emissions and as a reflection of the heavier feeds now being processed in FCC units. Most FCC units operate in "heat balanced" operation, with the heat energy needed to crack fresh feed being supplied by burning coke deposited on the catalyst during the cracking reaction. Flue gas formed by burning coke in the regenerator may be treated for removal of particulates and for conversion of carbon monoxide, after which the flue gas is discharged into the atmosphere.

Cracked products are fractionated into light, olefin rich gas, gasoline, light and heavy cycle oils, and slurry oils. The olefinic light gasses are usually alkylated with isobutane in the presence of sulfuric or HF acid, to produce high octane alkylate which is essentially free of aromatics. The cycle oils are valuable as fuel, and relatively refractory to further processing in the FCC. Many units recycle modest amounts of heavy material, sometimes heavy cycle oil or more likely slurry oil, the heaviest product. These materials, especially slurry oil, are very difficult to crack further, and much of the recycled material is converted to coke in the FCC, and some lighter product.

Most older FCC units regenerate the spent catalyst in a single dense phase fluidized bed of catalyst. Although there are myriad individual variations, typical designs are shown in U.S. Pat. No. 3,849,291 (Owen) and U.S. Pat. No. 3,894,934 (Owen et al), and U.S. Pat. No. 4,368,114 (Chester et at.) which are incorporated herein by reference.

Most new units are of the High Efficiency Regenerator (H.E.R.) design using a coke combustor, a dilute phase transport riser, and a second dense bed, with recycle of some hot, regenerated catalyst from the second dense bed to the coke combustor. Units of this type are shown in U.S. Pat. No. 3,926,778 (which is incorporated by reference) and many other recent patents. The H.E.R. design is used in most new units because it permits operation with less catalyst inventory (and hence less catalyst loss), and because such units tend to emit less CO and less NOx than the single dense bed regenerators.

In general, there has not been much integration of catalytic reforming and cat cracking. Catalytic reformate is usually considered a high octane product which does not need further upgrading, nor sulfur removal. In contrast, catalytically cracked gasoline, while usually of high octane, may require some further processing to remove sulfur compounds. So far as is known, no refiner has ever added reformate to an FCC, other than perhaps as a way of getting rid of off spec product or disposing of slop hydrocarbon streams. Although no integration of FCC and reforming per se has occurred, some work has been reported on fluidized bed catalytic processing of benzene rich streams.

Owen, in U.S. Pat. No. 3,969,426, which is incorporated herein by reference, reported that purified aromatic streams (benzene and toluene) could be used to convert durene, in a fluid bed reaction which generated almost no coke. Catalyst was regenerated intermittently, and preferably at a regeneration temperature of about 1000° to 1050° F. Although these conditions do not mesh well with conventional catalytic cracking operation, wherein coke deposition is needed for heat balanced operation, and regenerator temperatures are usually around 1200°–1350° F., the work was of interest because it showed that a mixture of durene, benzene and toluene could be converted in a bench scale riser reactor to a substantially durene-free, high quality gasoline product with only a trace loss of carbon to gas or coke. The feed was a mixture of durene (20 wt %) benzene (20 wt %) and toluene (60 wt %). The riser reactor used clean burned, 15 wt % REY zeolite catalyst having a 67.5 FAI. The riser reactor inlet mix temperature was 800° F. and 900° F. and the cat:oil ratio was 10.12. Essentially complete aromatic carbon retention was achieved, with less than 1 wt % of the feed going to coke, and about 0.5 wt % going to gas. Durene levels were reduced from 20 wt % to 0.2–0.4 wt %. Benzene levels were reduced from 20.0 wt % (feed) to 16.64 to 16.95 wt % (product).

Although this reduced the benzene content, it required the addition of durene to the gasoline boiling range material. The durene, if not almost completely eliminated, will appear in the gasoline product and cause problems because of its high melting point. Durene is not readily available in most refineries, it is primarily a by-product of methanol to gasoline processing.

Conversion of heavy reformate, or a pyrolysis naphtha having an IBP of 230–250 and EP of 350°–430° F., into benzene in a fluidized bed unit was reported in U.S. Pat. No. 4,066,531, Owen et al, which is incorporated herein by reference. A heavy reformate was reacted over a porous acid-active zeolite catalyst having a fluid activity index of at least 18, in the absence of added hydrogen, at 800° to 1200° F. in a fluidized system (a riser reactor is shown) having a catalyst residence time of 0.1 to 20 seconds. This would tend to increase the benzene content of the gasoline pool, because there is a net production of benzene.

To summarize, there is no way to effectively deal with the problem of too much benzene in reformate with known technology. Aromatics extraction will work, but costs too much. Aromatics alkylation with light olefins, even processes using relatively dilute benzene streams still requires a separate alkylation reactor, and consumes light olefins that could be converted into nonaromatic alkylate. Attempts to increase gasoline production in refineries having cat cracking units by recycling heavy cycle oil or slurry oil to the cracker will achieve only modest increases in gasoline production, and increase the amount of coke that must be burned in regenerators that are being pushed to their metallurgical limits in many instances.

We discovered a way to take a light reformate stream, and process this stream in a conventional catalytic cracking unit to reduce the benzene content of the reformate. We can convert benzene without isolating it from non-aromatics. The process works to reduce the benzene content of reformate even when essentially no changes are made to operation of the FCC, other than addition of a benzene containing reformate. In preferred embodiments, we increase the efficiency of benzene reduction in the fluidized catalytic cracking unit by modifying the unit, or adding the reformate in an unusual way, and using various feed and catalyst additives.

BRIEF SUMMARY OF THE INVENTION

Accordingly, the present invention provides a process for reducing the benzene content of a light reformate fraction containing C6 hydrocarbons including benzene comprising adding said light reformate fraction to a conventional catalytic cracking means operating at conventional catalytic cracking conditions to crack in a cracking reactor a conventional heavy feed to lighter products including a gasoline boiling range fraction and converting in said catalytic cracking reactor at least a portion of the benzene in the light reformate to heavier aromatic molecules.

In another embodiment, the present invention provides a fluidized catalytic cracking process wherein a heavy hydrocarbon feed comprising hydrocarbons having a boiling point above about 650° F. is catalytically cracked to cracked products comprising the steps of: catalytically cracking said feed in a catalytic cracking zone operating at catalytic cracking conditions by contacting said feed with a source of hot regenerated cracking catalyst to produce a cracking zone effluent mixture having an effluent temperature and comprising cracked products and spent cracking catalyst containing coke and strippable hydrocarbons; separating said cracking zone effluent mixture into a cracked product vapor phase and a spent catalyst rich phase; stripping and regenerating said spent catalyst to produce regenerated catalyst which is recycled to said cracking reactor zone to crack heavy feed; removing said cracked product vapor phase via a transfer line connective with a main fractionator which recovers liquid product fractions including a gasoline boiling range fraction; characterized by addition of a C6 reformate fraction comprising benzene to the cracking reactor zone and reducing therein the benzene content of said C6 reformate fraction.

In a preferred embodiment, the reformate is added to the base of a riser reactor upstream of the conventional feed.

Other preferred embodiments relate to addition of additives to the cracking reactor, preferably MCM-22 or ZSM-5, to produce a gasoline boiling range product with a reduced benzene content.

DETAILED DESCRIPTION

Figure 1:
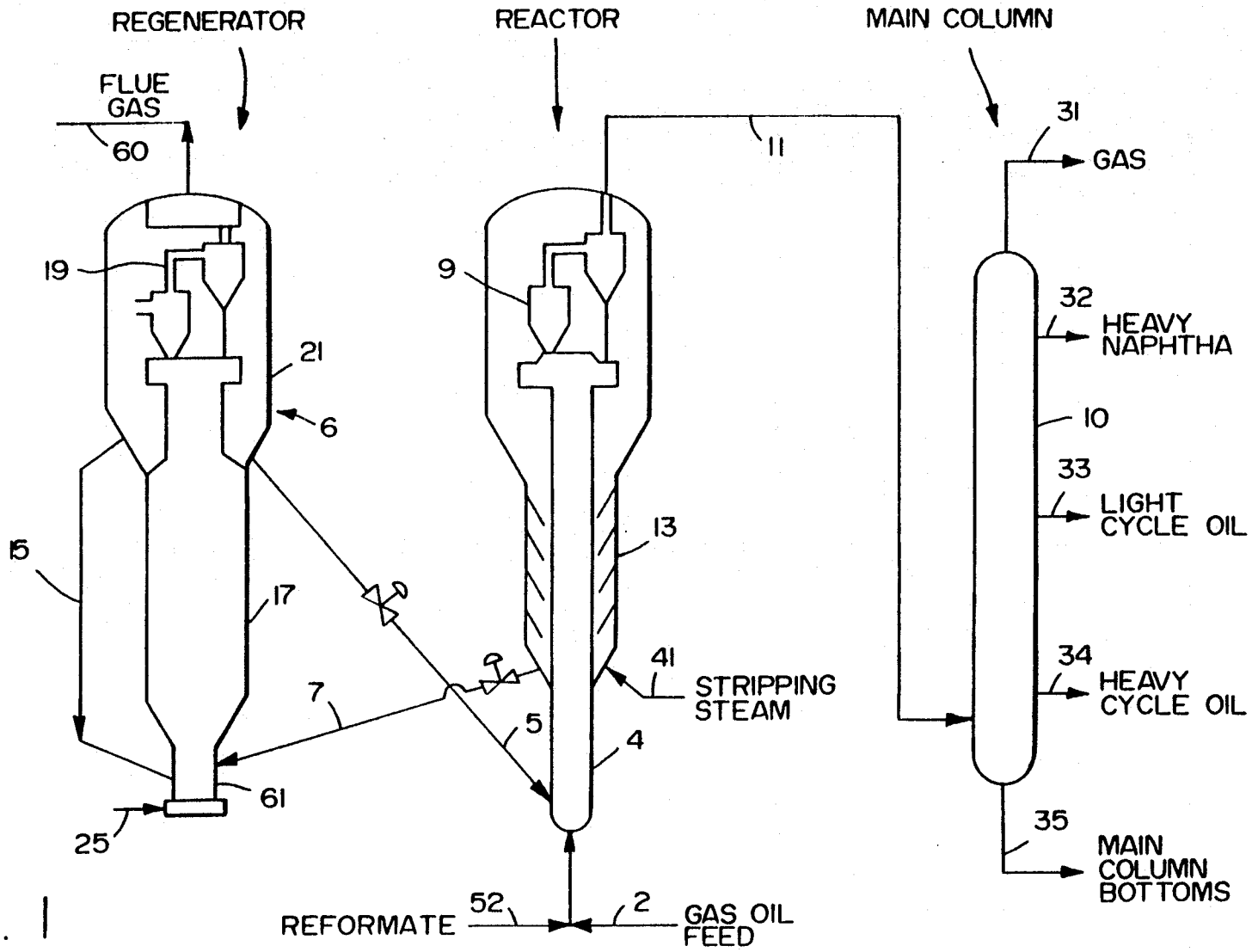
FIG. 1 is a simplified, cross-sectional view of a conventional, riser cracking FCC unit with a light reformate stream added to the conventional gas oil feed.

The invention can be better understood with reference to the drawings. FIG. 1 will first be discussed, it is, as far as hardware goes, a typical, prior art, all riser cracking FCC unit. Although the FCC hardware shown is conventional, addition of reformate to the feed is not. Thus FIG. 1 represents the generic practice of the present invention, namely addition of some light reformate to the conventional heavy feed to an FCC unit.

A heavy feed, typically a gas oil boiling range material, is charged via line 2 to mix with a light reformate stream in line 52, and the mixture is charged to the lower end of a riser cracking FCC reactor 4. Hot regenerated catalyst is added via conduit 5 to the riser. Preferably, some atomizing steam is added, by means not shown, to the base of the riser, usually with the feed. With heavier feeds, e.g., a resid, 2–10 wt. % steam may be used. The reformate, heavy hydrocarbon feed and catalyst mixture rises as a generally dilute phase through riser 4. The benzene in the reformate reacts with light reactive hydrocarbon species formed in the riser, or with heavier alkyl aromatics present in the riser, and forms alkyl aromatics. Cracked products and coked catalyst are discharged from the riser. Cracked products pass through two stages of cyclone separation shown generally as 9 in FIG. 1.

The riser 4 top temperature usually ranges between about 480° and 615° C. (900° and 1150° F.), and preferably between about 538° and 595° C. (1000° and 1050° F). The riser top temperature is usually controlled by adjusting the catalyst to oil ratio in riser 4 or by varying feed preheat.

Cracked products are removed from the FCC reactor via transfer line 11 and charged to the base of the main column 10. In some refineries, this column would be called the Syncrude column, because the catalytic cracking process has created a material with a broad boiling range, something like a synthetic crude oil. The main column 10 recovers various product fractions, from a heavy material such as main column bottoms, withdrawn via line 35, to normally gaseous materials, such as the vapor stream removed overhead via line 31 from the top of the column. Intermediate fractions include a heavy cycle oil fraction in line 34, a light cycle oil in line 33, and one or more gasoline boiling range fractions in line 32. Much of the reformate will be removed as a gasoline boiling range material in line 32. It is possible to provide multiple naphtha withdrawal points, e.g., a light naphtha and a heavy naphtha, or a single naphtha fraction may be sent to a splitter column to produce one or more naphtha boiling range fractions. These product recovery and fractionation steps are all conventional.

In the reactor vessel, cyclones 9 separate most of the catalyst from the cracked products and discharge this catalyst down via diplegs to a stripping zone 13 located in a lower portion of the FCC reactor. Stripping steam is added via line 41 to recover adsorbed and/or entrained hydrocarbons from catalyst. Stripped catalyst is removed via line 7 and charged to a high efficiency regenerator 6. A relatively short riser-mixer section 61 is used to mix spent catalyst from line 7 with hot, regenerated catalyst from line 15 and combustion air added via line 25. The riser mixer discharges into coke combustor 17. Regenerated catalyst is discharged from an upper portion of the dilute phase transport riser above the coke combustor. Hot regenerated catalyst collects in upper vessel 21 as a dense phase fluidized bed, and some of it is recycled via line 15 to the riser mixer, while some is recycled via line 5 to crack the fresh feed in the riser reactor 4. Several stages of cyclone separation are used to separate flue gas, removed via line 60. The catalyst regeneration sequence is conventional.

Figure 2:
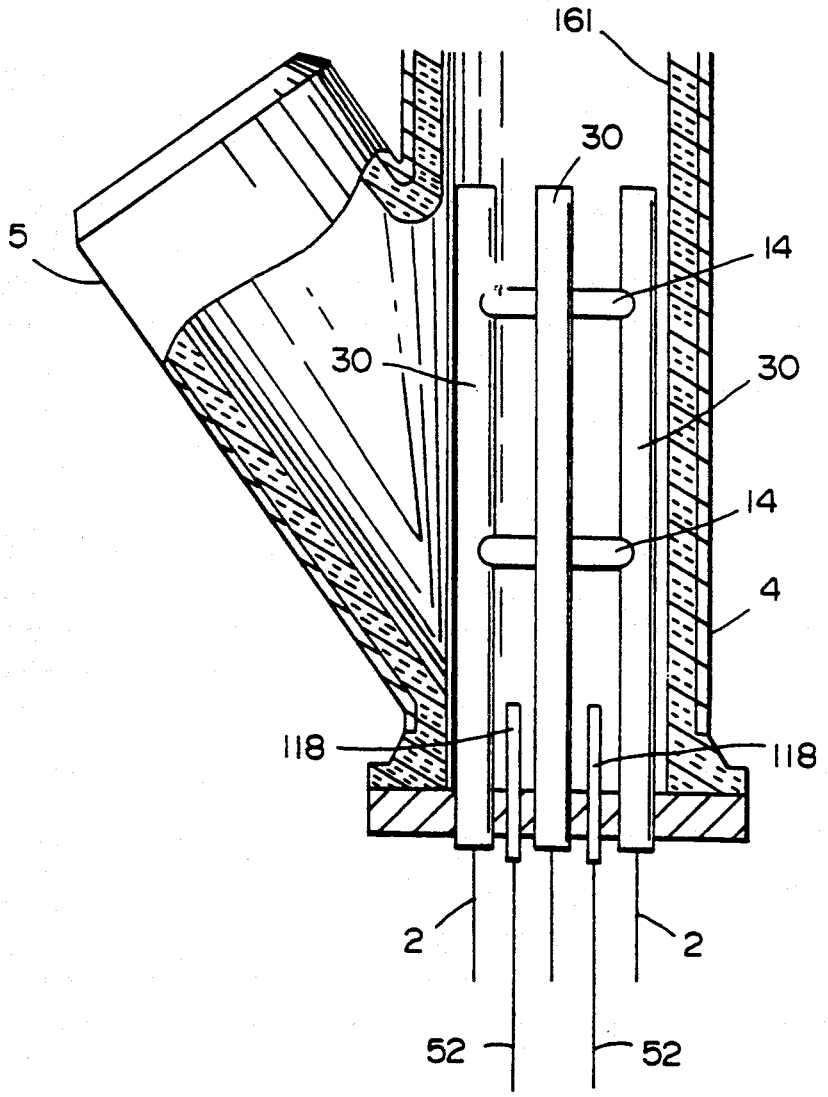
FIG. 2 is a simplified, cross-sectional view of an embodiment of the invention, with the light reformate added to the base of a riser reactor via blast nozzles, with the conventional feed added downstream in the riser.

A preferred embodiment of the present invention will now be described with reference to FIG. 2. FIG. 2 represents the riser base of an existing FCC unit, such as that shown in FIG. 1, modified to permit addition of light reformate to the base of the riser reactor via blast nozzles. Elements common to FIGS. 1 and 2 have the same reference numerals, e.g., the riser reactor 4 is the same in both FIG. 1 and FIG. 2, and has the same reference number.

FIG. 2 shows only the bottom of the riser reactor, most of the elements of which are identical to those in FIG. 1. The regenerator and the main column are not shown, but if shown would be identical to the regenerator and the main column shown in FIG. 1. Most of the hardware aspects of FIG. 2 are taken from FIG. 1 of U.S. Pat. No. 4,808,383, Buyan et al, FCC Reactor Multi-Feed Nozzle System, which is incorporated herein by reference. The improvement in the '383 patent was a better feed mixing device, not the addition of reformate to a riser reactor, at the base.

As in the FIG. 1 embodiment, a heavy feed, typically a gas oil boiling range feed and steam are charged via line 2 to the base of riser 4. Riser 4 is shown somewhat to scale, including the presence of large amounts of refractory lining 161. Steam and heavy hydrocarbon pass into a plurality of tubes 30, the upper ends of which discharge an oil and steam dispersion into a lower portion of riser 4. The tubes 30 are supported by support members 14. Hot regenerated catalyst is added via line 5 to the base of the riser 4. All this is conventional. Any other means of adding feed to a riser cracker can be used, such as spray nozzles, venturi mixers, etc.

The present invention, in the embodiment shown in FIG. 2, calls for separate addition of light reformate to hot regenerated catalyst prior to addition of the conventional heavy feed to the riser. The light reformate in line 52 is added to the riser via a single or multiple blast nozzles 118 distributed at the base of riser 4. The nozzles are referred to as blast nozzles not so much for the way they add reformate to the riser, but rather for what happens to the reformate once it enters the riser. The light reformate is "blasted" by contact with hot regenerated catalyst at extremely high cat:oil ratios. In the embodiment shown, all the catalyst is added to the base of the riser. As the amount of light reformate is typically 2 to 25% of the volume of conventional heavy feed, the cat:oil ratio experienced by the light reformate could be 4 to 50 times higher than that experienced by the conventional feed.

Although not shown in the drawing, it should be noted that the light reformate feed may, and preferably does, comprise other hydrocarbon and oxygenated hydrocarbon streams. These other streams may range from relatively low boiling materials, such as methanol, to light olefins or light paraffins from the cat cracker or other source. An especially preferred additive feed is a heavier aromatic stream, such as a stream comprising some C7, C8, or higher aromatics, preferably alkyl aromatics with multiple relatively short alkyl side chains. These additive feeds may be added with the reformate, with the conventional feed to the cat cracker, or added separately, either just before or just after addition of reformate to the cat cracking reactor.

These additives can promote alkylation reactions, transalkylation reactions, or both. A more detailed discussion of suitable additives, and the roles they play, is contained in a later portion of the specification.

The present invention can be used to reduce the benzene content of any reformate in any catalytic cracking unit, such as moving bed and fluid bed cat crackers. The invention will be most useful in conventional all riser cracking FCC units, such as disclosed in U.S. Pat. No. 4,421,636, which is incorporated by reference.

Although the present invention permits upgrading of reformate in both moving bed and fluidized bed catalytic cracking units, the discussion that follows is directed to FCC units which are considered the state of the art.

FCC FEED

Any conventional FCC feed can be used.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The feeds usually will have an initial boiling point above about 650° F.

REFORMATE FEED

Any conventional reformate, such as reformate from a fixed bed, swing bed, or moving bed reformer may be used. It is not even important to have a catalytic reformer in the same refinery as the catalytic cracking unit, the reformate can be imported into the refinery by tank car, pipeline, or similar means.

The most uplift in value will occur when a relatively light and narrow boiling range reformate, such as a C6 or C6 and lighter fraction, is a majority of the reformate charged to the catalytic cracking unit. By C6 fraction we mean the complex mixture of hydrocarbons recovered overhead by a dehexanizer column operating downstream of a depentanizer. The composition of such a product stream varies greatly from refinery to refinery, and can vary greatly depending on severity of operation in the reformer, changes in reformer feed, etc. The cut points, or splitting of such streams to remove C4 fractions, as in a debutanizer, C5 fractions in a depentanizer, or C6 fractions in a dehexanizer is a common refinery practice. The split or separation achieved is far from perfect, but in most refineries the spectrum of products produced by a dehexanizer will contain at least 80 wt % C6 hydrocarbons, and preferably at least 90 wt % C6 hydrocarbons.

Relatively low octane light reformate fractions, such as a C5/C6 stream, or a C6 stream, are readily fractionated from reformate, and especially susceptible to upgrading by the process of the present invention. A benzene and lighter reformate having a research clear octane number of 80 to 85, and preferably of 81 to 84, is readily upgraded in octane while the benzene content thereof is significantly reduced.

Although most refiners refer to such light hydrocarbon streams by carbon number, e.g., C6 or C5/C6, roughly equivalent streams can be defined by boiling range. Expressed in this way, the preferred feeds will comprise normally liquid materials having an end point of at most about 250° F., and preferably no higher than about 230° F. Very good results will be achieved when the light reformate feed boils within the range of 100°-212° F., and preferably within the range of 150°-200° F., and most preferably within the range of 160°-200° F. Expressed in metric units, the charge should contain all of the 80° C. boiling material and, given the limits of most commercial fractionators, it will be necessary to include material boiling at least about 5° C. above and below this temperature, and in many units it will be beneficial to have a 60°-90° C. material, or even a 50°-100° C. boiling range feed.

The amount of light reformate added, relative to the conventional heavy feed to the cat cracking unit, can vary greatly, depending on the amount of benzene removal required and on the spare capacity of the FCC reactor and downstream processing equipment to process the extra material. The light reformate will usually range from a low of 1 or 2 wt % of the total conventional feed, exclusive of recycle streams, to the FCC unit. Preferably light reformate comprises from 3 to 50 wt % of the conventional heavy feed to the FCC unit, more preferably from 5 to 40 wt %, and most preferably from 10 to 25 wt %.

The process of the present invention does not require a highly purified form of benzene feed, it tolerates relatively purified benzene streams, such as those produced by aromatics extraction units. In some refineries, there may be no demand for the benzene product from an aromatics extraction unit, or the refiner may be forced to extract benzene from a light product stream to comply with a product specification. In these instances, the present invention provides an efficient way to dispose of these unwanted, though purified, benzene streams, and at the same time increase the production of high octane FCC gasoline. When purified benzene streams are feed to the FCC, the benzene streams may contain significant amounts of other aromatics, e.g, a benzene - toluene (BT) or benzene - toluene - xylene (BTX) stream can be fed to the cat cracker.

The reformate feed preferably contains, or contacts, some additive feeds, which can be broadly classified as reactive light additive and much heavier alkyl aromatic additives.

REACTIVE LIGHT ADDITIVES

The process of the present invention also works well when, in addition to the light reformate, or upstream or downstream of the point of addition of light reformate to the riser, a reactive light additive such as a light hydrocarbon or oxygenate is added to the base of the riser. The reactive light additive may accomplish one or more of the following:

1. Generate reactive fragments which react with the conventional heavy feed.

2. Generate reactive fragments which react with the light reformate. The resulting reactive species alkylate the benzene to produce alkyl aromatics and thus reduce the benzene content.

3. Accelerate the catalyst to improve cat:oil contact in the riser.

The term reactive light gas or reactive light additive refers to any substance which will be readily vaporized in the conditions in the riser. Preferably the reactive light gas is selected from the group of methanol, ethanol, propanol and heavier alcohols, C2− refinery streams, liquified petroleum gas (LPG), ethane, ethylene, propane, propylene, butane, butylene, and similar materials. Use of ethanol and propanol are preferred due to their highly reactive properties.

The reactive light gas may be mixed in with the reformate, but preferably is added slightly ahead of the reformate so that reactive fragments can preferentially be formed from a relatively low value stream rather than somewhat more valuable light reformate.

The reactive light gas may also be added to the conventional heavy feed, but such mode of addition will not be as efficient in generating reactive fragments in the riser. Reactive fragments are beneficial not only for promoting reactions with benzene, but for promoting other beneficial reactions in the riser as well.

ALKYL AROMATIC ADDITIVES

It is possible, and usually will be preferred, to add to, or make available to, the reformate some relatively heavy aromatic hydrocarbons, preferably those with multiple alkyl side chains, to promote further reactions with the benzene in light reformate. These aromatics, especially those with multiple methyl or ethyl groups per aromatic ring, promote transalkylation reactions which reduce the benzene content of the gasoline recovered from the FCC unit. In this way the presence of large amounts of alkyl side chains, especially methyl groups, and to a lesser extent ethyl groups, reduces the equilibrium concentration of benzene in the light gasoline fraction discharged from the catalytic cracking unit.

One preferred stream is the C9+ fraction obtained from a superfractionator. Rather than further process this relatively heavy, relatively low value stream in a transalkylation or dealkylation unit, these heavy aromatic fractions can profitably be used to reduce the benzene content of light reformate, while increasing the octane, and to some extent the volume of the light gasoline pool.

Durene, containing four alkyl groups, is a by-product of the Methanol To Gasoline process, is a good alkyl aromatic additive.

Other useful alkyl aromatics streams, and ones which will always be available around an FCC unit, are light and heavy cycle oils, and even slurry oils, produced by the FCC. These are relatively refractory to conventional upgrading in the FCC, and are usually relatively low value products of an FCC unit. FCC naphtha, or more preferably FCC heavy naphtha may also be used, but these materials are usually more valuable than the cycle oils, and contain less alkyl aromatics than the cycle oils.

Other alkyl aromatic containing streams may also be used, such as coker naphtha, coker gas oils, or other equivalent alkyl aromatic rich streams. Some lube extracts may also be suitable for use.

The aromatic additives, when added, are preferably added with the light reformate. Most preferably a mixture of reformate and alkyl aromatics is subjected to "blast" conditions, discussed in more detail below, in the base of an FCC riser reactor.

The heavy aromatics may in some units also be added upstream of the light reformate, especially if they are available in excess and have a relatively low value. This will produce especially severe blasting of alkyl aromatics, create an abundance of reactive molecules and fragments which will rapidly react with reformate. There will be some loss of alkyl aromatics to coke and dry gas by such a practice, but reformate upgrading, and high octane, low benzene content gasoline production, will be maximized at the cost of somewhat increased consumption of alkyl aromatics. Care should be taken to adjust operating conditions so that benzene is ultimately consumed, rather than produced. It is possible, as reported in Owen U.S. Pat. No. 4,066,531, to convert heavy reformate into a liquid product rich in BTX.

The heavy aromatics may be added downstream of light reformate, or the heavy aromatics may simple be mixed with the conventional heavy feed, but their effectiveness will be somewhat reduced because of dilution, and/or reduced severity reaction conditions.

BLASTING

The most efficient removal of benzene from the reformate fed to the FCC unit will usually occur when the reformate is "blasted" in the base of the FCC riser, by contact with hot regenerated catalyst before the conventional heavy feed is added to the FCC riser. Blasting will occur when the FCC unit is operated conventionally with regard to the FCC heavy feed, but where the catalyst contacts the light reformate in the base of the riser first, and the resulting blasted reformate, and still hot and still active catalyst, contacts the conventional heavy feed within 0.1 to 1.0 seconds later.

When blasting is practiced, the catalyst to light reformate weight ratio will be much higher than the conventional cat:oil ratios used in FCC processing, because all or much of the catalyst will see only a relatively small hydrocarbon stream, comprising the light reformate stream, in the blast region. For most FCC units, operation with a catalyst to light reformate weight ratio in excess of 10:1, and preferably in excess of 12:1 will give very effective blasting conditions in the base of the riser.

RISER OUENCH

Although it is not essential, it will be beneficial in some installations to use an FCC riser reactor with a quench means. In such a reactor the heavy feed and the reformate, whether or not a blast zone is used, are subjected to unusually high temperatures in the base of the riser, and then quenched. Quench preferably takes place in the riser within 0.5 to 2 seconds of heavy feed residence time, but quench may also occur later, i.e., in a downstream portion of the riser, or at the riser outlet. Typical quench fluids may include water or steam, cycle oils and cooled catalyst.

Split feed, i.e., adding half of the heavy feed to the base of the riser, and the rest of the heavy feed halfway up the riser, will also create a more reactive zone in the base of the riser and may aid in conversion of benzene. In such an embodiment, the benzene should be added upstream of or with the heavy feed added to the base of the riser.

Riser quench and splitting feed to an FCC riser are known techniques, and are used primarily to improve processing of resids or increase gasoline octane number, respectively.

Use of riser quench may be especially useful when the feed contains more than 5 or 10 wt % resid, or materials boiling above about 1000° F.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt % of the catalyst, with the rest being matrix. Conventional zeolites such as X or Y zeolites, or aluminum deficient forms of these zeolites such as dealuminized Y (DEAL Y), ultrastable Y (USY) and ultrahydrophobic Y (UHP Y) zeolites may be used. The zeolites may be stabilized with Rare Earths, e.g., 0.1 to 10 wt % RE.

The catalyst inventory may also contain one or more additives, either present as separate additive particles, or mixed in with each particle of the cracking catalyst. Additives can be added to enhance octane (medium pore size zeolites, sometimes referred to as shape selective zeolites, i.e., those having a Constraint Index of 1–12, and typified by ZSM-5, and other materials having a similar crystal structure).

CO combustion additives are available from most FCC catalyst vendors.

The FCC catalyst composition, per se, forms no part of the present invention.

ALKYLATION/TRANSALKYLATION CATALYST

Although the conventional FCC catalyst, described above, has ample acid activity to achieve significant conversion of benzene in reformate via alkylation or transalkylation, the efficiency of benzene conversion may be increased by adding to the FCC catalyst inventory an additive catalyst which selectively promotes alkylation and/or transalkylation reactions.

Many additives heretofore added to increase octane, such as zeolites having a Constraint Index of 1–12, preferably ZSM-5, will also promote the conversion of benzene. ZSM-5 having a silica:alumina ratio above 30:1, and more preferable above 100:1, and most preferably above 250:1 or even 500:1 and higher, does not deactivate much under typical riser cracking conditions, and does not require frequent catalyst regeneration. When such additives are used, the additive catalyst can be manufactured to have selective fluidization properties (high densities and/or large particles) such that it remains at the base of a riser. The commingled benzene and optional light additives or alkyl aromatic additives such as cycle oil feeds would enter the base of the riser and react with the more selective transalkylation catalyst. This product would then continue up the riser as FCC feed with the regular fluid catalyst. The non-fluid circulating catalyst region would have an inventory higher in ZSM-5 than the riser of the FCC. To regenerate the non-fluid circulating catalyst, the catalyst could be drawn out of the base of the riser reactor and sent to the regenerator, or to a separate regenerator. It will also be possible to rely on random discharge from the riser reactor of the fast settling additive, which will allow sporadic regeneration of additive in the conventional regenerator associated with the FCC unit. It is also possible to modify conditions in the riser, at least periodically, to displace additive from the base of the riser. Higher vapor velocities, increased catalyst flows, etc., may be used to displace fast settling additive from the riser for sporadic trips to the catalyst regenerator.

The preferred additives are those crystalline materials which are highly selective for promotion of alkylation/ transalkylation reactions. Such a highly selective material is MCM-22, the composition and synthesis of which are described in U.S. Pat. No. 4,954,325, which is incorporated herein by reference.

SOx ADDITIVES

Additives may be used to adsorb SOx. These are believed to be primarily various forms of alumina, containing minor amounts of Pt, on the order of 0.1 to 2 ppm Pt.

Additives for removal of SOx are available from several catalyst suppliers, such as Davison's "R" or Katalistiks International, Inc.'s "DESOX."

FCC REACTOR CONDITIONS

As far as the conventional heavy feed is concerned, conventional riser cracking conditions may be used. Typical riser cracking reaction conditions include catalyst/oil ratios of 0.5:1 to 15:1 and preferably 3:1 to 8:1. Expressed as catalyst to conventional heavy feed, e.g., VGO, these numbers will be slightly different, e.g, it is preferred that the catalyst to heavy hydrocarbon feed ratio (exclusive of reformate, and light or heavy additives) is at least 4:1, and preferably is about 4:1 to 10:1. The conventional catalyst-heavy oil contact time will usually be 0.1–50 seconds, and preferably 0.5 to 5 seconds, and most preferably about 0.75 to 4 seconds, and riser top temperatures of 900° to about 1050° F.

The conventional FCC reactor tolerates very well the presence of large amounts of light reformate, whether the light reformate is added to the conventional feed or is first passed through a blast zone in the base of the riser. In most instances, the conventional cracking operation will remain essentially unchanged, except for a slight increase in gasoline boiling range material due to the addition of light reformate.

It is important to have good mixing of feed with catalyst in the base of the riser reactor, using conventional techniques such as adding large amounts of atomizing steam, use of multiple nozzles, use of atomizing nozzles and similar technology.

It is preferred, but not essential, to have a riser catalyst acceleration zone in the base of the riser. In the FIG. 2 embodiment, the light reformate serves several functions, acceleration of the catalyst, generation of reactive fragments which react beneficially with the heavy feed, and reduction in benzene content of the reformate.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al, which is incorporated by reference.

It is preferred but not essential, to rapidly strip the catalyst just as it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No.

3,821,103, Owen et al, which is incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated by reference.

The FCC reactor and stripper conditions, per se, can be conventional.

CATALYST REGENERATION

The process and apparatus of the present invention can use conventional FCC regenerators.

Preferably a high efficiency regenerator is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multi-stage regenerators, etc. The regenerator, per se, forms no part of the present invention.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

EXAMPLE 1 (INVENTION)

The following example shows that co-feeding a benzene rich naphtha with a conventional vacuum gas oil feed to an FCC will convert benzene. The test was not conducted in a riser reactor, it was conducted in a fixed fluidized bed used for laboratory simulation of conditions existing in commercial riser reactors.

The operating conditions were a Cat/Oil weight ratio of 8.38, a mix temperature (of feed and catalyst) of 984° F., and a feed oil partial pressure of 23.4 psi. The feed was a mixture of 90 wt. % VGO/bottoms and 10 wt % of a C5+ naphtha fraction, containing 10 wt % benzene. Experimental results are summarized below:

| Yields, wt % | Feed | Product |
|---|---|---|
| VGO/Bottoms | 90 | 7.15 |
| LCO | — | 16.50 |
| C5+ Naphtha | 10 | 48.78 |
| Benzene in C5+ | 10 | 8.0 |
| Light Gas | — | 17.39 |
| Coke | — | 10.18 |

The conversion is roughly 20% on benzene, with a margin of error perhaps as great as plus or minus 10% conversion, because of the difficulty of analyzing for smaller amounts of benzene.

EXAMPLE 2 (INVENTION)

The effect of adding alkyl aromatic rich streams on benzene conversion at conditions experienced in a FCC riser reactor was studied. The tests were conducted in a fixed fluidized bed used for laboratory simulation of conditions existing in commercial riser reactors.

BENZENE+FCC NAPHTHA

The first test used a feed of a mixture of 10 wt % benzene in FCC naphtha. This feed provides a rough indication of the amount of benzene that can be converted in an FCC riser reactor when the benzene feed is processed with a conventional, wide boiling range charge. The use of FCC naphtha (a product of the FCC process) is not the same as use of a gas oil feed, or other conventional feed to an FCC process, but the test still provides a qualitative indication of the results which should be achievable in a commercial unit. The results are reported below.

BENZENE IN LCO

The second feed stream consisted of 25% benzene added to FCC light cycle oil (LCO). LCO is much more aromatic than FCC naphtha, as is known to those skilled in the art. The experiment was conducted in the same test apparatus. The results are reported below:

| | 10% Benzene in FCC Naphtha | 25% Benzene in FCC LCO |
|---|---|---|
| Benzene Conversion, % | 30 | 29 |
| Catalyst/Oil Wt ratio | 15 | 16 |
| Temperature, F. | 1000 | 950 |

A detailed analysis of the feed and product streams for the second test, the one with 25% benzene, and 75% LCO is presented below, in Table 1.

TABLE 1

| Feed Component | Weight % in Feed | Weight % in Product |
|---|---|---|
| LCO | 75 | 48.0 |
| Coke + Light Gas | 0 | 18.6 |
| Naphtha Range | 25 | 33.4 |
| Naphtha Composition | | |
| Benzene | 25 | 17.7 |
| Alkyl-benzenes | 0 | 11.0 |
| PON | 0 | 2.5 |
| Naphthalenes | 0 | 2.2 |
| Benzene Conversion, wt % | — | 29% |
| Naphtha range, Ca. | .92 | .76 |
| Naphtha Blending RON | 103.4 | 103.8 |
| Blending RON of non-Benzene fraction of naphtha | — | 104.3 |

The data show an added benefit, namely generation of high octane naphtha boiling range material and conversion of LCO. In most refineries the gasoline boiling range material is about twice as valuable as the light cycle oil material.

We have found that the octane blending values for RON and MON increase from benzene to toluene to xylenes by about 2-3 octane for each methyl group added. Thus the actual upgrade should be taken on the generated product, with the unconverted benzene being recycled back to the reactor with more LCO.

EXAMPLE 3 (MCM-22 ADDITIVE)

This example shows the benefits of adding an alkylation additive, such as MCM-22, to improve the effectiveness of conventional FCC catalyst at promoting alkylation/transalkylation reactions.

In this example a conventional, equilibrium FCC catalyst, called Catalyst A, was first tested alone and then retested, when blended with MCM-22 to a 5 wt % zeolite basis. The feed is an FCC naphtha spiked to 10 wt % benzene. In addition to benzene conversion with the MCM-22 additive, paraffins are significantly reduced in the naphtha relative to pure Catalyst A. This increases production of light gases, especially C4's and lighter. Addition of MCM-22 thus increases alkylation/transalkylation reactions, and also increases olefin production from the FCC.

TABLE 2

| Catalyst | A + Additive | A |
|---|---|---|
| MB# | 82 | 42 |
| Temp | 1098 | 1083 |
| cat/oil | 18.1 | 20.7 |
| C5+ gasoline | 71.3 | 80.5 |
| C4's | 7.1 | 5.1 |
| Dry Gas | 13.1 | 7.1 |
| coke | 8.3 | 7.3 |
| RON | 103.3 | 101.8 |
| MON | 95.9 | — |
| Naphtha Composition, Total Feed Basis | | |
| Paraffins | 5.9 | 11.6 |
| Olef | 1.4 | 0.9 |
| DiOlef | 0 | 0 |
| Naphthenes | 0.7 | 1.9 |
| Benzene | 7.7 | 9.2 |
| Toluene | 13.6 | 12.8 |
| Xylenes | 17.4 | 18.9 |
| TrimethylBZ | 6.7 | 8.1 |
| Other AlkylBZ | 7.3 | 9.9 |
| Naphthalenes | 6.1 | 3.6 |
| Unknown Sats | 0 | 0 |
| Unknown Arom | 4.3 | 3.3 |
| wt % Arom C | 45.9 | 47.3 |
| RON Normalized to nearest 100 F. (1100 F./1000 F.) | 103.3 | 102.6 |

BENZENE DURENE EQUILIBRIUM

Other alkylating agents, or material which will generate alkylating agents, may also be used. Durene is a high boiling, and usually unwanted, by-product of the Methanol To Gasoline, MTG process.

Table 3 gives the equilibrium distribution from a 50/50 molar mixture of durene and benzene. The shows the potential for over 90% conversion of benzene to other alkyl components, and for conversion of over 95% of the durene to other alkyl components.

TABLE 3

| Component | Feed, Molar Composition | Equilibrated Molar Compos. |
|---|---|---|
| Benzene | 50 | 6 |
| Durene | 50 | 2 |
| Toluene | 0 | 26 |
| Xylenes | 0 | 39 |
| Trimethyl Benzenes | 0 | 22 |
| Other Tetramethy Bz. | 0 | 5 |

It should be noted that riser transalkylation of durene, and disproportionation of benzene-toluene product fractions is not, per se, novel. In U.S. Pat. No. 3,969,426 (Owen and Venuto), methanol was converted to gasoline and durene in a process using multiple riser conversion zones. Durene and BT were reacted in a riser to convert the durene.

ILLUSTRATIVE EMBODIMENT

The following illustrative embodiment is a yield estimate based on limited experimental data and our estimates. The data in the table do not reflect a single laboratory test of our invention. The data do reflect our estimate of what would occur in a field test of this invention.

The basis of the exercise is addition of 3900 BPD of C6− benzene light reformate stream (from a 17,350 BPD naphtha reformer) to an FCC unit processing 17,700 BPD of a conventional FCC feed, a vacuum gas oil (VGO).

The light reformate is added to the base of the riser reactor of the FCC, and the VGO added about 0.5 seconds later. In this way the light reformate is "blasted" in the base of the riser, before the VGO feed is added. The FCC operates at a 7 cat:oil ratio, based on VGO feed. The regenerated catalyst temperature is 1350° F. The riser top temperature is 1000° F. For these operating conditions, it is possible to estimate the composition shifts between benzene, toluene, ethyl benzene, and xylenes.

| | Light REFORMATE | TOTAL FCC GASOLINE | SHIFT IN REFORMATE | REFORMATE DELTA |
|---|---|---|---|---|
| END PT | C6 | 385 F. | | |
| BPD | 3900 | 14,900 | | |
| BENZENE BPD | 1500 | 430 | 210 | −1,290 |
| TOLUENE BPD | 0 | 920 | 450 | 450 |
| EB BPD | 0 | 246 | 120 | 120 |
| XYLENES BPD | 0 | 1,475 | 720 | 720 |
| OTHERS, BPD | 0 | 11,829 | — | — |
| R + 0 | 81.5 | 88.9 | 7.4 | |
| M + 0 | 77.1 | 80.8 | 3.7 | |

This shows a 5.6 number increase in road octane for a 3900 BPD stream, which amounts to about 2.4MM$/year at $0.30/octane barrel. The total FCC reformer benzene is reduced more than 75%.

Even further reductions are possible if some heavier alkyl aromatics are added, or if some additive catalysts, such as MCM-22 are incorporated into the FCC equilibrium catalyst.

The benzene content of gasoline is being regulated and benzene content is being reduced in many world markets. Rather than resort to costly aromatics extraction processes, which decrease the octane of a reformate stream, the process of the present invention reduces benzene content of reformate by conversion of the benzene to alkyl-benzenes. This is done in a catalytic cracking unit, with little capital expense required. In addition Research and Motor blended octanes are increased as a result of this process.

Addition of heavy alkyl aromatics, such as FCC cycle oils or durene to the process enhances conversion of benzene to toluene, xylenes and higher alkyl benzenes while simultaneously reducing the endpoint of the heavy aromatic, converting the low value, heavy aromatic component to more valuable lower endpoint components and increases octane. Thus, two relatively low value problem products, C6 reformate, and an alkylaromatic such as LCO or a durene rich stream, are upgraded to high octane gasoline blending components.

The process of our invention provides a powerful and beneficial new way for refiners to reduce the benzene content of reformate fractions, make gasoline having a high front end octane number and a reduced aromatic content, and also convert low value heavy aromatics streams to gasoline.

The process can be easily implemented in existing refineries with only minor or no modifications to the catalytic cracking unit.

In its simplest implementation, the reformate can simply be added to the conventional heavy feed to the FCC unit. This requires no capital costs, but achieves somewhat limited conversion of benzene.

To improve benzene conversion, we prefer to "blast" the reformate feed. It will usually be possible, at low expense, to add the reformate to the base of the riser, just below the conventional nozzles used to add the heavy feed.

Various light additives, or alkylaromatics such as durene or LCO or HCO may be added to the reformate feed to increase benzene conversion. These materials are preferably added to the blast zone, or mixed with the reformate, or even may be mixed with the conventional feed.

Catalyst additives, such as ZSM-5 or MCM-22 or other catalysts which promote alkylation/transalkylation reactions in a cat cracker may be added if desired to increase benzene conversion.

We claim:

1. A process for reducing the benzene content of a light reformate fraction comprising C6 hydrocarbons and benzene characterized by operating a conventional catalytic cracking means at conventional catalytic cracking conditions and cracking in said catalytic cracking reactor a conventional heavy feed to lighter products including a gasoline boiling range fraction and adding said light reformate fraction to said catalytic cracking reactor and converting in said cracking reactor said conventional heavy feed and at least a portion of the benzene in the light reformate to heavier aromatic molecules.

2. The process of claim 1 wherein the light reformate fraction is added in an amount equal to 2 to 50 wt % of said conventional heavy feed.

3. The process of claim 1 wherein the light reformate fraction contains a number of moles of benzene, and the catalytically cracked gasoline product contains fewer moles of benzene than the moles of benzene in the reformate feed.

4. The process of claim 1 wherein the light reformate is mixed with the conventional heavy feed to the cracking reactor.

5. The process of claim 1 wherein the light reformate is added to the cracking reactor before the conventional heavy feed is added to the cracking reactor.

6. The process of claim 5 wherein the catalytic cracking means is an all riser fluidized catalytic cracking (FCC) unit, and the FCC riser has a base section connective with a source of hot regenerated catalyst, at least one heavy feed nozzle means is operatively connected with the heavy feed source and is adapted to spray the heavy feed into the riser reactor via nozzle outlets at an elevation above the base of the riser reactor, and wherein the light reformate is added to a blast zone in the base of the riser below the heavy feed nozzle outlets.

7. The process of claim 6 wherein the light reformate added to the blast zone in the base of riser is mixed with 10–90 wt % of methanol, ethane, ethylene, propane, propylene, butane, butylene, and mixtures thereof.

8. The process of claim 6 wherein the light reformate added to the blast zone in the base of the riser is mixed with 10–90 wt % of an alkyl aromatic rich stream.

9. The process of claim 1 wherein the light reformate added to the riser is mixed with 10–90 wt % of an alkyl aromatic rich stream.

10. The process of claim 1 wherein the riser means comprises a riser quench means for injection of a quench fluid downstream of the point of addition of the heavy feed, whereby there is a reduction in reaction severity in the riser reactor downstream of the point of introduction of the heavy feed.

11. The process of claim 6 wherein the catalyst to light reformate weight ratio is at least 10, and the catalyst to heavy hydrocarbon feed weight ratio is at least 4.

12. In a fluidized catalytic cracking process wherein a heavy hydrocarbon feed comprising hydrocarbons having a boiling point above about 650° F. is catalytically cracked to cracked products comprising the steps of:

a. catalytically cracking said feed in a catalytic cracking zone operating at catalytic cracking conditions by contacting said feed with a source of hot regenerated cracking catalyst to produce a cracking zone effluent mixture having an effluent temperature and comprising cracked products and spent cracking catalyst containing coke and strippable hydrocarbons;

b. separating said cracking zone effluent mixture into a cracked product vapor phase and a spent catalyst rich phase;

c. stripping and regenerating said spent catalyst to produce regenerated catalyst which is recycled to said cracking reactor zone to crack heavy feed;

d. removing said cracked product vapor phase via a transfer line connective with a main fractionator which recovers liquid product fractions including a gasoline boiling range fraction; the improvement comprising addition of a C6 reformate fraction comprising benzene to the cracking reactor zone and reducing therein the benzene content of said C6 reformate fraction.

13. The process of claim 12 wherein the light reformate fraction is added in an amount equal to 2 to 50 wt % of the heavy feed.

14. The process of claim 12 wherein the light reformate fraction contains a number of moles of benzene, and the catalytically cracked gasoline product contains fewer moles of benzene than the sum of the moles of benzene in the reformate feed and the moles of benzene generated via cracking of heavy feed.

15. The process of claim 12 wherein the light reformate is mixed with the heavy feed to the cracking reactor.

16. The process of claim 12 wherein the light reformate is added to the cracking reactor before the heavy feed is added to the cracking reactor.

17. The process of claim !2 wherein the catalytic cracking zone comprises an all riser cracking reactor fluidized catalytic cracking (FCC) unit, and the FCC riser reactor has a base section connective with a source of hot regenerated catalyst, at least one feed nozzle means operatively connected with the heavy feed for spraying the heavy feed into the riser reactor via nozzle outlets at an elevation above the base of the riser reactor, the light reformate is added to the base of the riser below the heavy feed nozzle outlets, and the catalyst to light reformate weight ratio is at least 10, and the catalyst to heavy hydrocarbon feed ratio is at least 4.

18. The process of claim 17 wherein the light reformate added to the base of riser is mixed with 10–90 wt % of methanol, ethane, ethylene, propane, propylene, butane, butylene, and mixtures thereof.

19. The process of claim 18 wherein the light reformate added to the base of riser is mixed with 10–90 wt % of an alkyl aromatic rich stream.

20. The process of claim 17 wherein the catalytic cracking zone comprises an all riser cracking reactor fluidized catalytic cracking (FCC) unit, and the FCC riser reactor comprises a riser quench means for injection of a quench fluid downstream of the point of addition of the heavy feed, whereby there is a reduction in reaction severity in the riser reactor downstream of the point of introduction of the heavy feed.

* * * * *